United States Patent [19]

Spitz

[11] 3,930,934

[45] Jan. 6, 1976

[54] SPEED OPTIMIZATION CONTROL FOR FIBROUS SHEET MAKING MACHINES SUCH AS PAPER MAKING MACHINES WITH DRYER LIMITED CONDITIONS

[75] Inventor: David Allan Spitz, Columbus, Ohio

[73] Assignee: Industrial Nucleonics Corporation, Columbus, Ohio

[22] Filed: June 5, 1974

[21] Appl. No.: 476,464

Related U.S. Application Data

[63] Continuation of Ser. No. 232,858, March 8, 1972.

[52] U.S. Cl. ..... 162/198; 162/253; 162/256; 162/258; 162/263; 235/151.1

[51] Int. Cl.[2].... D21F 1/06; D21F 5/00; D21F 9/02; D21F 11/02

[58] Field of Search ..... 162/198, 263, 252, 258, 162/256, 253; 235/151.1; 34/44, 45

[56] References Cited

UNITED STATES PATENTS

| | | | |
|---|---|---|---|
| 3,564,224 | 2/1971 | Chope | 162/DIG. 6 X |
| 3,564,724 | 2/1971 | Keyes et al. | 162/DIG. 6 X |
| 3,649,444 | 3/1972 | Futch, Jr. | 162/198 |
| 3,666,621 | 5/1972 | Adams | 162/198 |
| 3,687,802 | 8/1972 | Rummel et al. | 162/263 |

OTHER PUBLICATIONS

"Some Plain Talk on Digital Computers"; Roberts *Pulp & Paper;* Aug. 12, 1968; p. 32–37.

"Goal: Computer Control from 1 year of Order"; *Pulp & Paper;* Apr. 1970.

*Primary Examiner*—S. Leon Bashore
*Assistant Examiner*—Steve Alvo
*Attorney, Agent, or Firm*—William T. Fryer, III; C. Henry Peterson; Allan M. Lowe

[57] ABSTRACT

Specifically disclosed is the combination of a paper making machine and a control system including an automatic arrangement which, on demand of the machine operator, performs a coordinated machine speed increase, maintaining the paper sheet characteristics substantially constant until the dryer steam pressure or the steam valve opening reaches a limit. During the speed increase, a number of other machine variables are compared with set limit values and the speed increase is discontinued when a limit is exceeded for a predetermined time period. When the steam pressure has been at a limit, or the steam valve has been wide open, for a predetermined time period the control system, upon sensing the limit being reached, switches to a dryer limited mode of operation wherein the steam pressure is maintained at the limit or the steam valve is locked open. The sheet moisture content is then controlled by a combination of automatic stock valve and machine speed adjustments, while basis weight is controlled by coordinated machine speed adjustments. The control system is adapted for universal use with many machine arrangements which may have separated and/or split dryer sections for rewet or coating operations and the like and/or curl control. To this end, the controller includes a system of logic which determines the optimum control procedure in each case.

5 Claims, 5 Drawing Figures

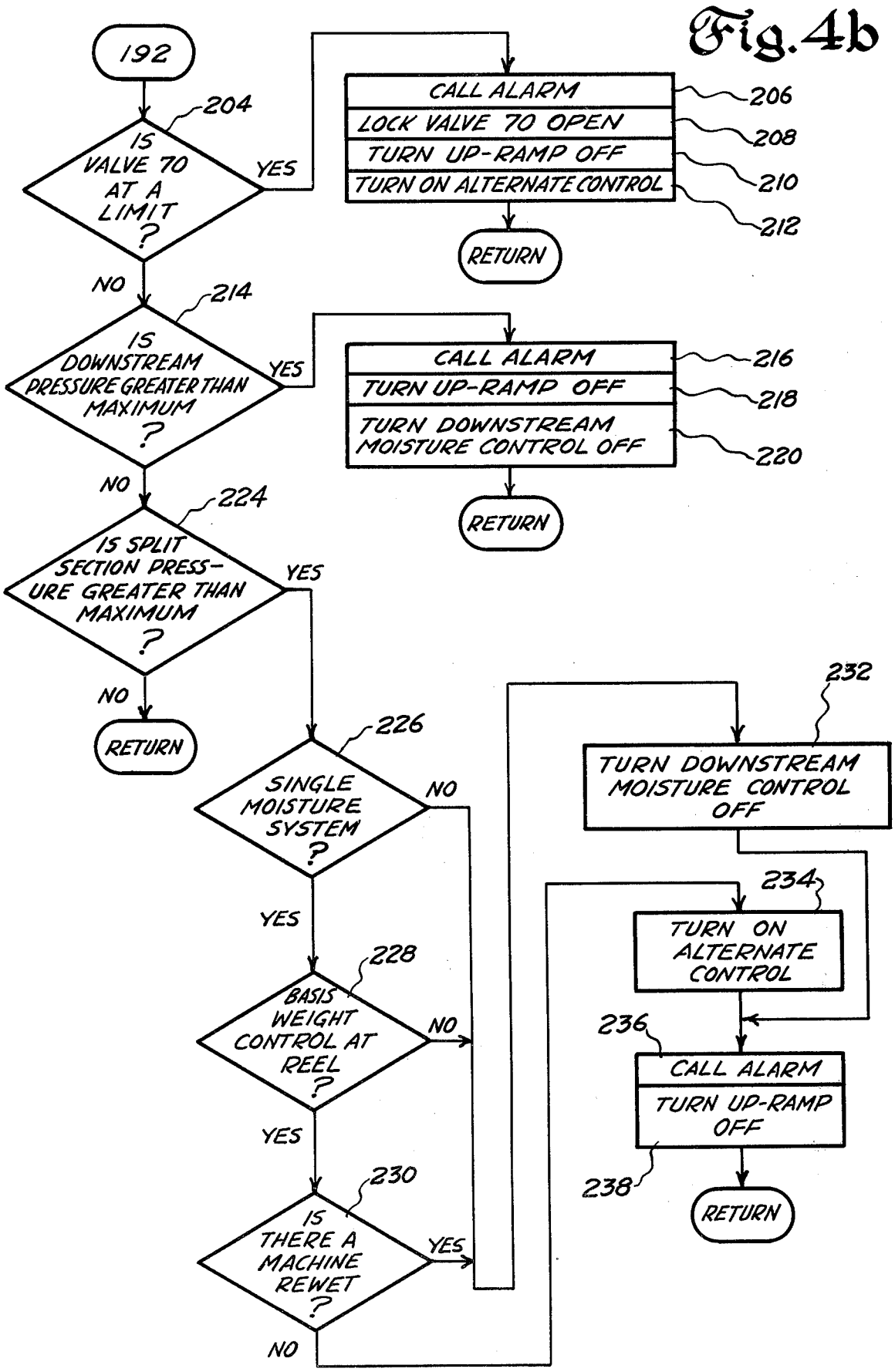
Fig. 4b
192
204
IS VALVE 70 AT A LIMIT ?
YES
NO
CALL ALARM
LOCK VALVE 70 OPEN
TURN UP-RAMP OFF
TURN ON ALTERNATE CONTROL
206
208
210
212
RETURN
214
IS DOWNSTREAM PRESSURE GREATER THAN MAXIMUM ?
YES
NO
CALL ALARM
TURN UP-RAMP OFF
TURN DOWNSTREAM MOISTURE CONTROL OFF
216
218
220
RETURN
224
IS SPLIT SECTION PRESSURE GREATER THAN MAXIMUM ?
YES
NO
RETURN
226
SINGLE MOISTURE SYSTEM ?
NO
YES
228
BASIS WEIGHT CONTROL AT REEL ?
NO
YES
230
IS THERE A MACHINE REWET ?
YES
NO
232
TURN DOWNSTREAM MOISTURE CONTROL OFF
234
TURN ON ALTERNATE CONTROL
236
CALL ALARM
TURN UP-RAMP OFF
238
RETURN

SPEED OPTIMIZATION CONTROL FOR FIBROUS SHEET MAKING MACHINES SUCH AS PAPER MAKING MACHINES WITH DRYER LIMITED CONDITIONS

This application is a continuation of application Ser. No. 232,858, entitled "Speed Optimization Control for Fibrous Sheet Making Machines Such as Paper Machines", filed Mar. 8, 1972, with David Allan Spitz the inventor.

This invention relates to a speed optimizing control system for fibrous sheet making machines such as paper making machines.

For background information, reference can be made to the U.S. Pat. Nos. to Donaldson, 1,135,000, Hamilton 1,674,720, Kruse 1,926,292 and Dahlin 3,575,798. Reference can also be made to a survey textbook entitled *Computer Control of Industrial Processes* by E. S. Savas, McGraw-Hill, 1965, pages 360–361. The speed optimization system of the present invention is an improvement to an over-all control system, for paper making machines and the like, whose various features are described in four related co-pending applications of James S. Rice, identified as Ser. No. 857,324 filed Sept. 12, 1969 for "Non-interacting Control . . .", now U.S. Pat. No. 3,676,295, issued on July 11, 1972, and Ser. No. 8,292, now U.S. Pat. No. 3,703,436, issued Nov. 21, 1972, and Ser. Nos. 8,377 now U.S. Pat. No. 3,852,578 and 8,383, and now abandoned, all filed Feb. 3, 1970 for "Headbox Control . . .", "Control System and Method . . .", and "System and Method for Performing Coordinated Changes . . .", respectively.

It is the object of this invention to provide a system and method of speed optimization control which achieves truly maximum production speed, where desired, under a variety of different dryer limited conditions, while achieving the best possible regulation of both basis weight and moisture either under dryer limited conditions or otherwise.

The more specific objects and advantages of the invention will become apparent in the following detailed description, taken in conjunction with the appended drawings in which.

Figures 2, 3:
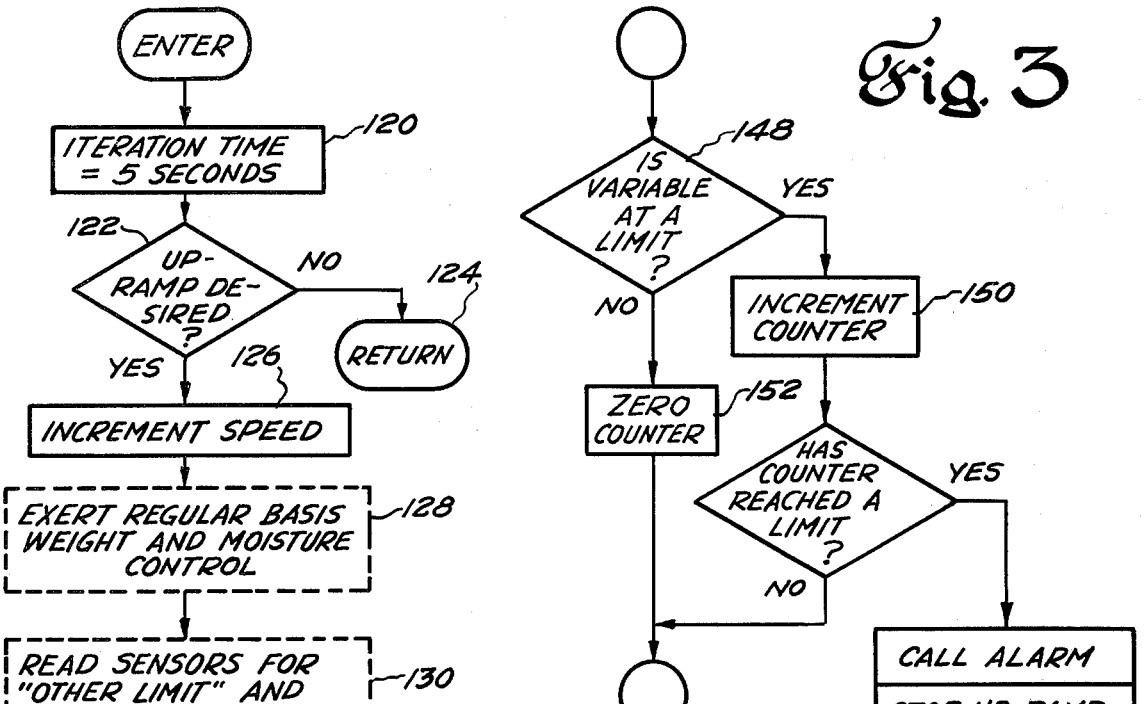
FIG. 2 is a generalized flow chart for an up-ramp control program for the computer system of FIG. 1.
FIG. 3 is a generalized flow chart of a limit check routine used in the program of FIG. 2.
Figure 4A:
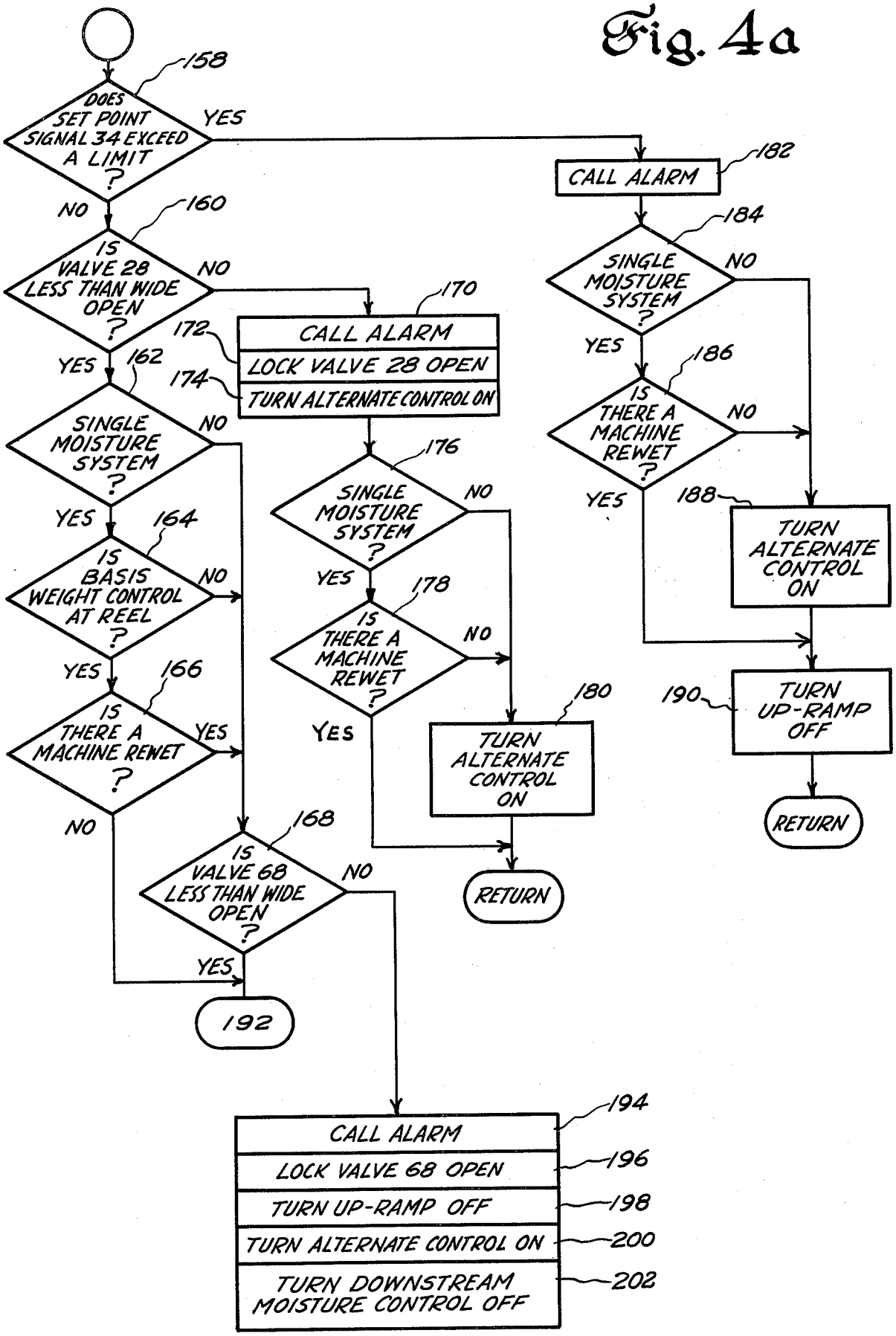

FIGS. 4*a* and 4*b* is a detailed flow chart for performing operations 142 and 144 of FIG. 2.

Figure 1:
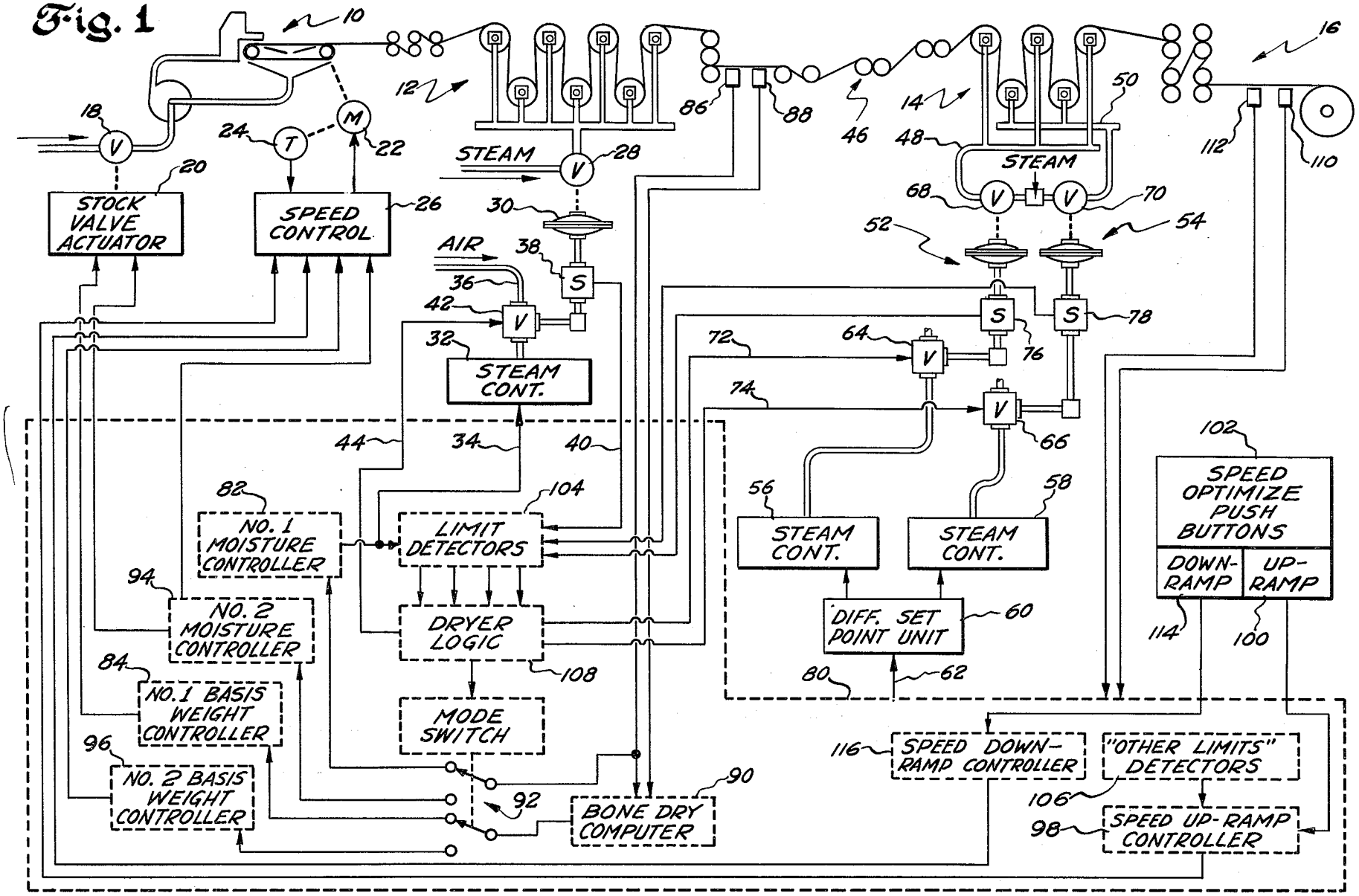
FIG. 1 is a simplified schematic showing of a Fourdinier paper making machine incorporating a control system according to the invention.

Referring now to FIG. 1, there is shown a conventional paper making machine having a Fourdinier section 10, an upstream dryer section 12, a downstream dryer section 14 and a calender and reel section 16.

Fiber for forming the paper sheet is fed to the machine through a stock valve 18 controlled by an actuator 20. The machine speed is illustrated as being established by the speed of a motor drive 22 for the couch roll and controlled by speed control 26, which responds to tachometer 24.

The drying rate for the upstream dryer 12 is shown to be controlled by a steam valve 28 having a pneumatic actuator 30 supplied by the air pressure from a steam controller 32. Steam controller 32 is typically an analog controller which is responsive to either the steam pressure supplied to dryer 12 or the temperature of the dryer, as compared to a set point electrical signal on line 34. In a known manner, steam controller 32 effects a comparison between the existing stream pressure or dryer temperature and a set-point value, and supplies air pressure to penumatic actuator 30, which opens steam valve 28 to an opening directly proportional to the applied air pressure.

Controller 32 is supplied with air, from a regulated pressure source, not shown. A portion of the regulated pressure is delivered by the controller to actuator 30 through a two-way valve 42 and is measured by a pressure sensor 38 to provide a signal on line 40 proportional to the pressure and hence proportional to the steam valve opening. Valve 42 is a conventional solenoid-operated two-way valve which is adapted to cut off the air pressure to the actuator 30 from controller 32 and instead apply the regulated pressured from a pipe 36 directly to the actuator, bypassing the steam controller 32. The air pressure supply from line 36 is substantially higher than the pressure normally supplied to actuator 30 from controller 32, and insures that steam valve 28 will be driven to its wide open position. While the elements described are per se conventional, the arrangement employing solenoid valve 42 is a modification according to the present invention to insure that steam valve 38 is locked open whenever a signal is applied to the valve via line 44.

The dryer system is split into upstream 12 and downstream 14 sections to admit an additional operation therebetween at location 46 for a rewet operation, coating operation, or the like. The downstream dryer 14 is of a well-known type adapted for curl control by supplying the upper and lower sets of rolls through two separate steam headers 48 and 50.

The steam valves for the respective sections are controlled by separate actuator and control arrangements 52 and 54 which are similar to those just described for controlling the steam valve 28. However, the two separate steam controllers 56 and 58 receive set-point signals from a differential set-point unit 60 of a known type. The master set-point signal, for controlling the over-all drying rate of the dryer section 14, is supplied via line 62 to the differential set-point unit, and the unit 60 simply adds or subtracts a fixed increment to the master set-point signal before it is applied to one or both of the set-point inputs fed to controllers 56 and 58. The typical example of unit 60 would be an electrical network comprising a manually adjusted potientiometer for providing a positive or negative biasing voltage, and one or more summing networks for supplying the sum of the master set-point and biasing signals to the steam controllers. Again, the control arrangements so far described for the downstream dryer are conventional, except for the modification of providing two solenoid-operated two-way valves 64 and 66 whereby the steam valves 68 and 70 can be locked open by signals applied on lines 72 and 74 respectively. The pressures applied to the actuators for valves 68 and 70, and hence the valve positions, are sensed by sensors 76 and 78.

Coordinating control for the system described is performed by a supervisory control system indicated by the irregular box 80 enclosed by the heavy dashed line. Preferably the box 80 comprises a general-purpose digital computer adapted for process control, although it will be apparent that its functions can be performed by a special-purpose hard-wired digital computer or even an analog computer. Included within the box 80 are shown a number of dashed-line rectangles which in the preferred embodiment represent specific algorithms which computer 80 is programmed to execute. In alternate embodiments, these rectangles could represent suitable special-purpose computers adapted to perform equivalent functions under the control of a master timing and logic device.

Two very important control functions are performed by the basis weight and moisture controllers 82 and 84. In the preferred arrangement, controllers 82 and 84 represent algorithms for execution by a general-purpose digital computer as described in detail in the above-referenced Rice applications, Ser. Nos. 8,377 and 8,383. In one common arrangement which is illustrated for simplicity, controllers 82 and 84 are responsive to a moisture gauge 86 and a basis weight gauge 88 installed to scan the paper sheet which has been dried by dryer section 12.

The signals from these gauges are fed into a conventional bone dry basis weight computer 90. Moisture controller 82 is responsive to the output of moisture gauge 86, and computes the set point signal which is fed over line 34 to the steam controller 32 for the upstream dryer section 12. Basis weight controller 84 is responsive to the bone dry basis weight output signal from computer 90 and provides a control signal to the actuator 20 for the stock valve 18.

The moisture and bone dry basis weight signals are shown to be routed to the moisture and basis weight controllers 82 and 84 through a switching arrangement comprising a mode switch 92. It is indicated that when the mode switch is in the alternate position, the moisture and bone dry signals are alternatively fed to a second moisture controller 94 and a second basis weight controller 96. Thereby it is to be understood that the functions of the first moisture and basis weight controllers 82 and 84 are eliminated, and control is transferred instead to a second set of moisture and basis weight controllers 94 and 96. It is to be noted that instead of providing an output as a set point to steam controller 32, the second moisture controller 94 provides a set-point output to the speed control 26 and also provides an output to stock valve actuator 20. It is further to be noted that the output of the second basis weight controller 96 is fed as a set-point to speed control 26.

Briefly stated, moisture and basis weight controllers 94 and 96 control the machine in a dryer-limited mode. When the dryers are operating at their maximum capacity, and if the paper is too wet, the only way to correct the existing condition is to reduce the amount of water per unit time which is carried by the sheet through the dryers; i.e., the stock flow must be reduced. Concomitantly, in order to prevent a change in basis weight from occurring, it is necessary to reduce the machine speed. With the stock valve opening set according to the moisture control criterion, assuming, for instance, a fixed stock valve position, a change in the bone dry basis weight can only be effected by changing the machine speed.

It is frequently desired to operate a paper making machine at the highest possible speed, in order to maximize production. A number of maximizing schemes have been proposed in the past. For example, it has been proposed to increase speed until the final moisture content of the machine rises above some maximum moisture level which is to be maintained. There are several disadvantages to this arrangement in that moisture would probably have to increase a relatively large amount, and the speed would have to be reduced at the end to control the desired moisture. Also, if there are several drying units, moisture would have to be measured for each unit. Moreover, it would be difficult to keep such a system at a true dryer limit, because the dryer limit in this case is physically undefined.

It has also been proposed to measure the steam pressure from the steam plant, and at infrequent intervals, to set the machine speed to some value less than the maximum speed permitted under true dryer limited conditions, in response to the measured pressure. With this system it was proposed that moisture control be achieved using the steam valve, operating near the wide open limit, to regulate the dryers. There are likewise several difficulties with this proposal; for example, there is no intrinsic relationship between moisture content and steam flow or steam pressure which can be used to correlate these variables, the machine is obviously not being operated at truly maximum speed, and the steam control becomes very "mushy" and unprecise in the vicinity of a wide open condition.

According to the present invention, a speed up-ramp controller 98 is activated when the machine operator operates an up-ramp pushbutton 100. The pushbutton 100 is located on a speed-optimize control section 102 of one of the operators' control panels. When the speed up-ramp controller is activated, it makes repeated small increases to the machine speed at intervals of five seconds by increasing the set point for speed control 26. It is understood that the showing of only a single direct connection between speed up-ramp controller 98 and speed control 26 is schematic only for purposes of simplified explanation. The speed increase in fact takes place according to a fairly complex algorithm which may be that fully described in the above-referenced Rice application Ser. No. 8,383 and is therein termed an "on-grade speed change".

The speed-up of the machine takes place according to a stepwise ramp function whose 5-second increments are scaled so that the speed increases at the rate of 1 percent in 5 minutes (0.2 percent per minute). During the speed up-ramp, normal moisture control is effected by the use of steam valve 28 and moisture controller 82 in response to moisture gauge 86. The bone dry basis weight is maintained at the desired value by suitable adjustments of stock valve 18 effected by basis weight controller 84 in response to bone dry computer 90.

During the up-ramp, the steam valve openings, as indicated by signals from sensors 38, 76 and 78 are monitored by an arrangement of limit detectors indicated by box 104. Limit detectors 104 also monitor the outputs of conventional steam pressure sensors, not shown, which are connected to dryer sections 12 and 14 in a conventional manner. Limit detectors 104 furthermore monitor the upstream dryer pressure set point being fed to steam controller 32 via line 34.

During the speed up-ramp, a number of variables other than those associated with the steam valve openings or steam pressures are monitored by an arrangement designated by the box 106 labeled "other limits" detectors. Specific variables which are monitored by limits detectors 106 are the beater chest level control valve, the machine chest level control valve, the consistency control valve and the decculator control valve. These valve positions are measured by conventional sensors (not shown) such as the valve position sensor 38, and the outputs of these sensors are compared with set limits in a conventional way. The named other limits detectors thus insure that the machine will not run out of heavy stock, or receive stock of grossly incorrect consistency or meet with similar mishaps, since when one of the limits is exceeded the speed up-ramp which had been initiated by the up-ramp pushbutton is discontinued. It is obviously appropriate where necessary to include limit detectors for other parameters in the group of "other limits" detectors 106, such as mechanical limits, a maximum mechanical speed limit or the like which are conventionally monitored on paper machines.

Whereas the activation of one of the "other limits" detectors simply discontinues the speed up-ramp, the activation of one of the limit detectors 104 associated with the dryers causes the control system to switch to the dryer-limited mode by operation of mode switch 92 so that the basis weight and moisture will be controlled in the alternate mode using moisture controllers 94 and 96 as previously described.

In the case of a simple machine which may have only the one dryer section 12, wherein the downstream dryer 14 is not present and where the paper is wound on a reel at location 46 instead of being subjected to some other operation thereat, the mode switch 92 may be switched to provide the alternate, dryer-limited control whenever one of the limits detected by detectors 104 is exceeded for a predetermined time. On such a simple machine, the intervening dryer logic box 108 would be unnecessary. However, since the controller of the invention is adapted to control more complex machines such as that illustrated, the dryer logic system 108 is provided.

The machine illustrated, including the downstream dryer 14, is shown to be equipped with basis weight and moisture gauges 110 and 112 at the reel. Such a full complement of gauges would be required, for example, on a machine where a precise coating operation is performed. With such an arrangement, both the final basis weight and the coating weight per unit area, as well as the base sheet weight per unit area, and the moisture contents could be derived from the gauge signals. Also in such an arrangement, the moisture gauge 112 would probably provide the input signal for controlling the downstream dryer by computing an appropriate set point signal to be applied on line 62 to the differential set point unit 60.

It is apparent to one skilled in the art that there are at least eight different combinations of machines and controls possible, depending on whether there is one or two dryer units, whether moisture control is exercised on the first section only, the second section only, or on both sections as shown, and depending on whether the downstream dryer (or simply the last few rolls of a "single" dryer section) has a split section for curl control. It is the purpose of the dryer logic 108 to set up the proper conditions, as by locking certain valves, turning on or off certain controls, alarms and the like, in order to permit proper control of the machine in the dryer-limited condition as will be described more fully hereinafter.

Assuming that the alternate or dryer limited control mode using controllers 94 and 96 has been in effect, when the operator desires to turn off the speed-maximize control, he presses a down-ramp pushbutton 114 which activates a speed down-ramp controller 116. This controller reduces the machine speed by a preset amount, in spaced steps with stock flow coordination in a manner similar to the technique used for changing speed during automatic grade changes, in a manner similar to that described in the Rice application 8,383, supra. As soon as the down-ramp has been initiated, the down-ramp controller changes the mode switch arrangement to restore normal basis weight and moisture control using controllers 82 and 84.

As previously noted, in accordance with the preferred embodiment of the invention computer 80 comprises a general purpose process control digital computer which is programmed to execute at least one operation, such as an algorithm or subroutine, for each of the functional blocks within the heavy dashed line box 80 of FIG. 1. Also as previously noted, while the preferred arrangements for moisture controller 82 and basis weight controller 84 functions are those described in prior applications, it is apparent that there are a number of known commercial arrangements which could alternatively be used.

FIG. 2 is an overall flow chart of the operations performed during the up-ramp control phase, showing the relationship of the several algorithms. Once the program is entered, an interation time is set or verified in operation 120. A suitable time for conventional Fourdinier paper making machines is 5 seconds.

In operation 122, a test is made to see if a flag has been set to a binary one state by operation of the up-ramp pushbutton 100. If the flag is not set, as shown by the return operation 124 the program is discontinued until another five second interval has elapsed. If the flag is found to be in a binary one state, indicating that the up-ramp program is desired, an increment of speed is added to the existing machine speed as indicated by operation 126. As described in the Rice application Ser. No. 8,383, supra, the addition of a speed increment is in itself a complex algorithm whereby, before the speed is increased, the stock valve 18 is opened a predetermined amount, as is the steam valve 28, to anticipate and substantially nullify the effects on basis weight and moisture when the speed of the machine is increased. The actual speed increase takes place after a time delay sufficient to allow the extra flow of heavy stock to be delivered to the head box slice.

By operation 128, it is indicated that regular basis weight and moisture control functions are exercised during the up-ramp. This operation box is outlined by dashed lines, since it is shown for reference only and is not per se a part of the five second up-ramp routine. Box 130 indicates operations in which the computer reads the sensors for the above described "other limit" and steam pressure and valve limit variables. In operation 132, the values of the other limit variables obtained from the sensors are compared with predetermined limits, and a test is made for each variable to see if the limit is exceeded for a predetermined time, selected to be two minutes for the typical Fourdinier machine. If a limit has been exceeded for 2 minutes, the operator is alerted by a suitable alarm in operation 134 and the speed optimization program is turned off as shown by operation 136.

If none of the limits has been exceeded for 2 minutes, a similar test is made for the steam limits in operation 138, and if no limit has been exceeded for a time period of 2 minutes, as indicated by the return operation 140 the up-ramp cycle is repeated after a 5 second interval.

If the result of operation 138 indicates that a steam valve or steam pressure limit has been exceeded for 2 minutes, a dryer logic routine 142 is performed, and appropriate valve or valves are locked open as indicated by operation 144, and dryer limited control is initiated as indicated by box 146. It is apparent that operation box 146 performs the function of mode switch 92 of FIG. 1 in switching from regular moisture 82 and basis weight controllers 84 to the alternate controllers 94 and 96.

FIG. 3 is a flow chart of a preferred way of timing the length of time that one of the variables connected with operations 132 and 138 is at a limit. As indicated by operation 148, the measured value of the variable is compared with a limit. If the measured value equals or exceeds the limit value, a counter is incremented as indicated by operation 150. More specifically, a memory slot in the computer is reserved for each variable to be tested. If the operation 148 decision is "yes", the number standing in the designated memory slot is replaced with a number one integer larger, thus providing a count of the number of times decision operation 148 has shown the variable to exceed the limit. Since the iteration time for the up-ramp program is 5 seconds, a count of twenty-four standing in the counter is an indication that the variable has been at the limit for two minutes. If the result of the 148 operation decision is "no", the number standing in the memory slot is replaced with a zero, as indicated by operation 152. In operation box 154 the counter reading is compared with a limiting number, specifically 25, and if the limiting number has not been equalled or exceeded the program proceeds to the next operation 156. If the count has reached the limit, appropriate actions such as sounding an alarm or stopping the up-ramp are performed. FIG. 4 is a detailed flow chart for performing operations 142 and 144 of FIG. 2.

Referring now to FIG. 4, which is in two parts, FIG. 4*a* and FIG. 4*b*, the program is generally self-explanatory from the legend in the various boxes. However, a few comments are in order. Boxes as at 170, 182, 194, 206, 216, and 236 simply indicate that an appropriate message should be typed out for the benefit of the operator, and/or an appropriate signal lamp or multiple alarm be activated, all in conventional manner.

The designation in boxes such as 174, 188, 200, 212 and 234 labled "turn alternate control on" indicate that control is to be exercised in the alternate, dryer limited mode using moisture controllers 94 and 96 of FIG. 1.

The decision boxes as at 162, 176, 184 and 226 labled "single moisture system?" simply indicate that the computer examines a particular memory slot for a preprogrammed indication as to whether there is more than one moisture gauge control system. A "no" indication would be obtained if the machine had the configuration of FIG. 1, since there are two moisture control systems, one using moisture gauge 96 and the other using moisture gauge 112, for the upstream and downstream sections.

Similarly, a preprogrammed indication in a designated computer memory slot is examined to determine if there is a machine rewet, as indicated by decision boxes 166, 178, 186 and 230. Likewise, the information in a memory slot is examined as indicated by boxes 164 and 228 to determine if there is basis weight control at the reel, utilizing basis weight gauge 110.

The obvious advantages of this logic system are not only that a single program can be used for almost any type of fibrous sheet forming machine, but also it permits a particular machine to be run at different times with different combinations of dryer elements, coaters, rewet operations and the like.

No detailed description of the alternate basis weight and moisture control program is necessary, except to note that the magnitude of a single machine speed correction should be limited to a predetermined value in order to prevent excessive transient moisture changes. It is apparent that paper entering a dryer which at a given speed would be exposed to the drying action for a given length of time, will not receive the drying action for the same length of time if in the meantime the machine has been accelerated or decelerated. This inevitably causes some transient change in the moisture content. The magnitude of each change in machine speed should therefore be limited in accordance with the amount of moisture upset which can be tolerated. Specific procedures for determining and limiting the magnitude of single corrections are set forth in the Rice application Ser. No. 8,383, supra.

The down-ramp program likewise needs no explanation, except to note simply that its purpose is to effect a speed reduction of a predetermined amount, normally one or two percent, as fast as possible. Again, the magnitude of each individual speed reduction step must be limited, with the total speed change divided into a suitable number of corrections, for example, as described in the Rice application.

It is appropriate to note that the steam controllers 32, 56 and 58 are conventionally of a type which include integral action, and are thus subject to what is termed "wind-up" during the time that the valves 42, 64 or 66 are operated to supply pressure directly to the steam valve actuators. Thus, in order to insure a "bumpless" transfer of control from the dryer limited mode to the regular mode, suitable anti-windup provisions should be made according to known procedures. The recommended procedure is to use the technique whereby the set point input as at 34 to the controller 32 is matched with the actual pressure applied to actuator 30 which may be measured by sensor 38.

What is claimed is:

1. In a control system for a fibrous sheet making machine having means for regulating the flow of fibrous material to the machine to control the basis weight and for regulating the dryer system to control the moisture content of the sheet, the improvement of means responsive to a speed up-ramp signal for increasing the speed of the machine, means responsive to the dryer system for detecting a limiting condition for the operation thereof which could prevent the dryer from removing a substantially greater amount of moisture per unit time, and means responsive to detection of said limiting condition for discontinuing said regulating and substituting therefor first and second signals for regulation of the fibrous material flow and machine speed, respectively, to control the moisture content and prevent a change in basis weight when the moisture is changed and a third signal to regulate the machine speed to control basis weight.

2. The method of controlling a fibrous sheet making machine including a first dryer system for the sheet, said machine may include a second dryer system that may be operational, and may include a moisture control system and a bone dry basis weight control system for said second dryer system, and said machine may include a rewet system that may be operational, which comprises providing the machine with: (a) a first control system including means for regulating the flow of fibrous material to the machine to control the basis weight and for regulating the first dryer system to control the moisture content of the sheet, (b) an alternate second control system having means for producing first and second signals for regulating the fibrous material flow and machine speed, respectively, to control the moisture content and prevent a change in basis weight when the moisture content is changed and a third signal for regulating the machine speed in response to measurement of basis weight to control the basis weight, and a computer means having a memory, storing in said computer memory indications of the presence or absence on said machine of at least one of an operating: second dryer system, machine rewet system, second moisture control system, and second basis weight control system, increasing the speed of the machine controlling the machine with said first control system until a dryer limiting condition is reached, detecting said limiting condition for at least one of the dryers which could prevent the dryer from removing a greater amount of moisture per unit time, and responding to the detection of said limiting condition and to said presence or absence indications to perform at least one of the operations of: (a) terminating the speed increase, (b) disabling the second moisture control system, and (c) in response to the detection of the limiting condition, controlling the machine with said alternate second control system in substitution for said first control system.

3. A method for controlling a fibrous sheet forming machine having a stock valve, a steam dryer with a steam valve and means for controlling the speed of the sheet being formed, the drying rate of the dryer having a limit, comprising:

a. controlling the sheet basis weight and moisture content with the stock valve and steam valve respectively, while increasing the speed of the sheet until the limit on the dryer rate is reached:

b. sensing the limit condition being reached discontinuing step (a) above and, c. in response to the limit on the dryer rate being reached, controlling the sheet moisture with first and second signals that change the stock valve and sheet speed, respectively, to prevent a change in basis weight when the moisture is changed, while controlling the sheet basis weight with a third signal that changes the sheet speed, and at the same time maintaining the dryer drying rate at the limit.

4. Apparatus for controlling a fibrous sheet producing machine having a stock valve, a steam dryer with a steam valve, means for controlling the speed of the sheet being produced and an operator input for initiating the speed control, comprising means for signalling the occurrence of a limit condition for the steam dryer such that a limit for its sheet drying ability is attained, means responsive to the operator input and the limit signalling means indicating that the dryer limit has not been reached for concomitantly controlling the stock valve and steam valve to control sheet bone dry basis weight and moisture, respectively, while activating the sheet control means to increase speed until the limit signalling means indicates that the dryer limit has been reached, and means responsive to the limit signalling means indicating that the dryer limit has been reached for discontinuing operation of said stock valve and steam valve control means and concomitantly producing a first signal controlling the sheet basis weight by controlling the sheet speed and second and third signals controlling the sheet moisture by controlling the stock valve and sheet speed, respectively, to prevent a change in basis weight when the moisture content is changed while maintaining the steam valve such that the dryer remains at the limit.

5. Apparatus as claimed in claim 4 wherein the means for signalling the limit condition includes means for sensing the opening of the steam valve, and means responsive to the steam valve being fully open to indicate that the dryer limit has been reached for locking the steam valve in the fully open condition.

* * * * *